US008100514B2

(12) United States Patent
Kim et al.

(10) Patent No.: US 8,100,514 B2
(45) Date of Patent: Jan. 24, 2012

(54) INKJET HEAD ACTUATOR AND MANUFACTURING METHOD OF THE SAME

(75) Inventors: Sang Jin Kim, Seoul (KR); Jae Woo Joung, Gyunggi-do (KR)

(73) Assignee: Samsung Electro-Mechanics Co., Ltd., Suwon (KR)

( * ) Notice: Subject to any disclaimer, the term of this patent is extended or adjusted under 35 U.S.C. 154(b) by 537 days.

(21) Appl. No.: 12/314,620

(22) Filed: Dec. 12, 2008

(65) Prior Publication Data

US 2010/0020132 A1 Jan. 28, 2010

(30) Foreign Application Priority Data

Jul. 28, 2008 (KR) ..... 10-2008-0073614

(51) Int. Cl.
*B41J 2/045* (2006.01)

(52) U.S. Cl. ..... 347/70

(58) Field of Classification Search ..... 347/70
See application file for complete search history.

(56) References Cited

FOREIGN PATENT DOCUMENTS

| | | |
|---|---|---|
| JP | 1-283153 | 11/1989 |
| JP | 6-134983 | 5/1994 |
| JP | 2004-255869 | 9/2004 |
| JP | 2005-96346 | 4/2005 |
| JP | 2007-210331 | 8/2007 |
| KR | 10-2002-0049703 | 6/2002 |
| KR | 10-0682964 | 2/2007 |
| KR | 10-2007-0082692 | 8/2007 |

OTHER PUBLICATIONS

Japanese Office Acton issued Mar. 1, 2011 in corresponding Japanese Patent Application 2008-315666.

Korean Office Action issued on Jul. 1, 2010 in corresponding Korean Patent Application 10-2008-0073614.

*Primary Examiner* — Matthew Luu
*Assistant Examiner* — Lisa Solomon

(57) ABSTRACT

There are provided an inkjet head actuator and a manufacturing method of the same. The inkjet head actuator includes: a vibration plate having a recess formed in a top surface thereof; a first electrode formed to cover a bottom surface and a side wall of the recess; a piezoelectric body formed on the first electrode to fill the recess; and a second electrode formed on the piezoelectric body. The inkjet head actuator having the thin film piezoelectric body and the vibration plate ensures large vibration displacement.

12 Claims, 4 Drawing Sheets

INKJET HEAD ACTUATOR AND MANUFACTURING METHOD OF THE SAME

CROSS-REFERENCE TO RELATED APPLICATIONS

This application claims the priority of Korean Patent Application No. 2008-0073614 filed on Jul. 28, 2008, in the Korean Intellectual Property Office, the disclosure of which is incorporated herein by reference.

BACKGROUND OF THE INVENTION

1. Field of the Invention

The present invention relates to an inkjet head actuator and a manufacturing method of the same, and more particularly, to an inkjet head actuator including a thin film piezoelectric body and a vibration plate to ensure large vibration displacement and a low driving voltage.

2. Description of the Related Art

In general, an inkjet head is a device for printing an image of a predetermined color on a printing material by ejecting fine droplets of a printing ink onto a desired location of the printing material such as paper or textile. This inkjet head is classified variously according to the ink ejection method. One type is a heat-driven inkjet head which generates bubbles in ink using a heat source and ejects the ink by an expansion force of the bubbles. Another type is a piezoelectric inkjet head which ejects ink by a pressure applied to the ink resulting from transformation of a piezoelectric body.

In the piezoelectric inkjet head, an actuator refers to a configuration encompassing a chamber plate 101, a vibration plate 102, a piezoelectric body 104, and upper and lower electrodes 105 and 103, as shown in FIG. 1, while excluding a restrictor, a reservoir, a chamber and a nozzle. However, the actuator may be configured without the chamber plate 101. In this case, the piezoelectric body 104 is disposed between the upper electrode 105 and the lower electrode 103. Also, a bottom surface of the lower electrode 103 is joined to the vibration plate 102. Also, a bottom surface of the vibration plate 102 is joined to the chamber plate 101. In this piezoelectric inkjet head, the actuator is a significant element in determining ink ejection capability of the inkjet head, and should advantageously ensure large vibration displacement upon application of a voltage and a lower operating voltage. To this end, the piezoelectric body 104 and the vibration plate 102 need to be thinned as much as possible.

SUMMARY OF THE INVENTION

An aspect of the present invention provides an inkjet head actuator including a thin film actuator and a vibration plate to ensure large vibration displacement and a low driving voltage.

An aspect of the present invention also provides a method of easily manufacturing the inkjet head actuator.

According to an aspect of the present invention, there is provided an inkjet head actuator including: a vibration plate having a recess formed in a top surface thereof; a first electrode formed to cover a bottom surface and a side wall of the recess; a piezoelectric body formed on the first electrode to fill the recess; and a second electrode formed on the piezoelectric body.

The piezoelectric body may have a thickness of 20 to 30 μm. The top surface of the vibration plate may be co-planar with a top surface of the piezoelectric body.

The piezoelectric body may be bonded to the first electrode.

The vibration plate may be formed of silicon.

According to another aspect of the present invention, there is provided a method of manufacturing an inkjet head actuator, the method including: forming a recess in one surface of a vibration plate; forming a first electrode to cover a bottom surface and a side wall of the recess; forming a piezoelectric body on the first electrode to fill the recess; polishing the one surface of the vibration plate where the recess is formed and an exposure surface of the piezoelectric body such that the vibration plate and the piezoelectric body are reduced in thickness.

The forming a piezoelectric body on the first electrode to fill the recess may include bonding the piezoelectric body to the first electrode.

The polishing the one surface of the vibration plate where the recess is formed and an exposure surface of the piezoelectric body may include polishing the vibration plate and the piezoelectric body simultaneously.

The polishing the one surface of the vibration plate where the recess is formed and an exposure surface of the piezoelectric body may include polishing the vibration plate and the piezoelectric body to be co-planar with each other.

The polishing the one surface of the vibration plate where the recess is formed and an exposure surface of the piezoelectric body may include polishing the piezoelectric body to a thickness of 20 to 30 μm.

The polishing the one surface of the vibration plate where the recess is formed and an exposure surface of the piezoelectric body may include performing chemical mechanical polishing.

The forming a piezoelectric body on the first electrode may include polishing the piezoelectric body to a thickness of 80 to 120 μm.

The vibration plate may include an etching blocking layer formed therein.

The forming a recess in one surface of a vibration plate may include etching the vibration plate up to the etching blocking layer.

BRIEF DESCRIPTION OF THE DRAWINGS

The above and other aspects, features and other advantages of the present invention will be more clearly understood from the following detailed description taken in conjunction with the accompanying drawings, in which.

DETAILED DESCRIPTION OF THE PREFERRED EMBODIMENT

Figure 1:
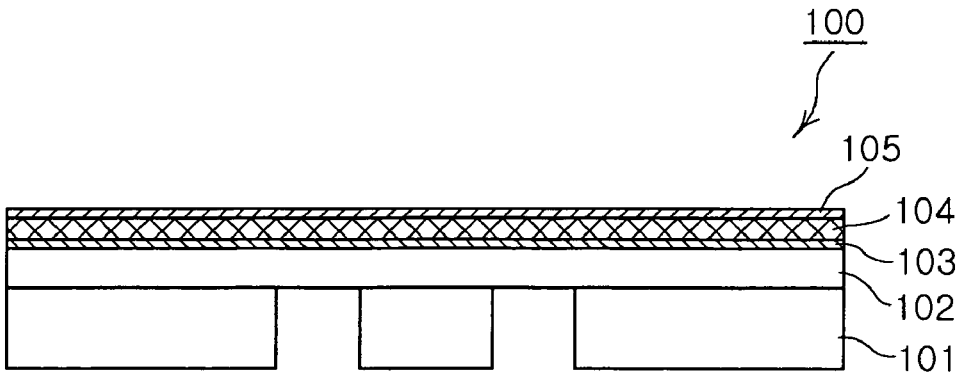
PRIOR ART FIG. 1
FIG. 1 is a cross-sectional view illustrating a conventional inkjet head actuator.

Exemplary embodiments of the present invention will now be described in detail with reference to the accompanying drawings. This invention may, however, be embodied in many different forms and should not be construed as limited to the embodiments set forth herein. Rather, these embodiments are provided so that this disclosure will be thorough and complete, and will fully convey the scope of the invention to those skilled in the art. In the drawings, the shapes and dimensions may be exaggerated for clarity, and the same reference signs are use to designate the same or similar components throughout.

Figure 2:
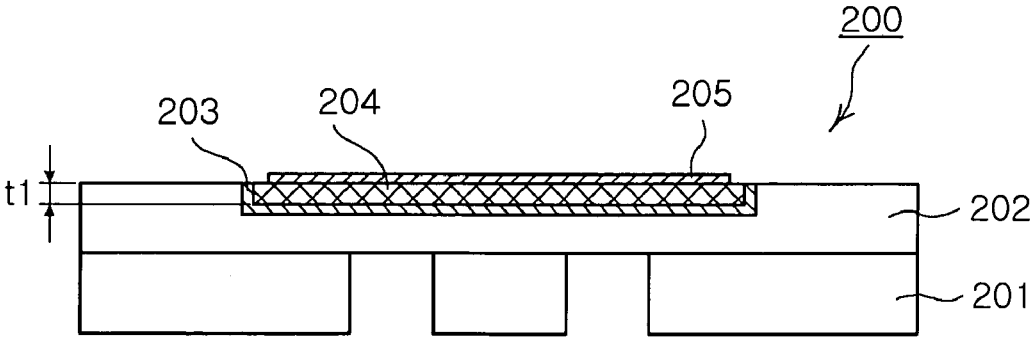
FIG. 2 is a cross-sectional view illustrating an inkjet head actuator according to an exemplary embodiment of the invention.

FIG. 2 is a cross-sectional view illustrating an inkjet head activator according to an exemplary embodiment of the invention.

Referring to FIG. 2, the inkjet head activator 200 of the present embodiment includes a chamber plate 201, a vibration plate 202, a lower electrode 203, a piezoelectric body 204 and an upper electrode 205. The chamber plate 201 has an inner space for accommodating a liquid which is to be ejected. The liquid can be ejected by vibration of the vibration plate 202. Here, the chamber plate 201 and the vibration plate 202 may be formed of e.g., silicon to be integral with each other. However, the inkjet head activator 200 may be configured without the chamber plate 201.

The vibration plate 202 changes a volume of the liquid-accommodating space of the chamber plate 201 by vibration of the piezoelectric body 204. Particularly, in the present embodiment, the vibration plate 202 has a recess formed in a top surface thereof. The lower electrode 203 and the piezoelectric body 204 are sequentially formed to fill the recess of the vibration plate 202. That is, the lower electrode 203 is formed to cover a bottom surface and a side wall of the recess of the vibration plate 202 by depositing a conductive material. Also, the piezoelectric body 204 is formed on the lower electrode 203 to be vibrated by an electrical signal.

As will be described later, the piezoelectric body 204 is not initially formed as a thin film. But the piezoelectric body 204 is bonded to the lower electrode 23 as a bulk having a relatively great thickness of about 100 μm, and then polished to a desired thickness t1. Here, the piezoelectric body 204 is polished to a thickness t1 of 20 to 30 μm. This thin film piezoelectric body 204 can increase vibration displacement and accordingly lower a driving voltage. Moreover, the inkjet head activator reduced in thickness can simplify a driving waveform, thus ensuring less interference among vibration cells of the actuator. Meanwhile, the piezoelectric body 204 may be formed of any material used in the art, for example, a ceramic piezoelectric body or a crystal piece.

FIGS. 3A through 3E are procedural cross-sectional views illustrating a method of manufacturing the inkjet head activator structured as shown in FIG. 2.

Figure 3A:
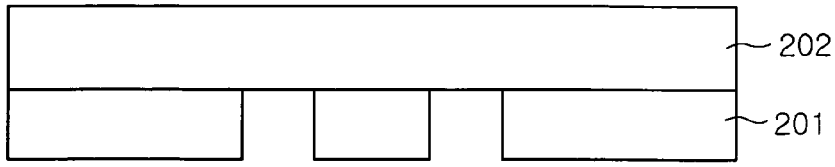
FIGS. 3A through 3E are procedural cross-sectional views illustrating a method of manufacturing the inkjet head actuator structured as shown in FIG. 2.

First, as shown in FIG. 3A, the chamber plate 201 and the vibration plate 202 are provided. Although not illustrated in detail, the chamber plate 201 is adequately etched into a desired shape to have an inner space for accommodating a liquid. Then, the chamber plate 201 is bonded to the vibration plate 202. Here, the vibration plate 202 is polished to a smaller thickness by a later process. Therefore, the vibration plate 202 may have at least a predetermined thickness, for example, a thickness enabling the polishing process to be easily regulated after bonding the piezoelectric body.

Figure 3B:
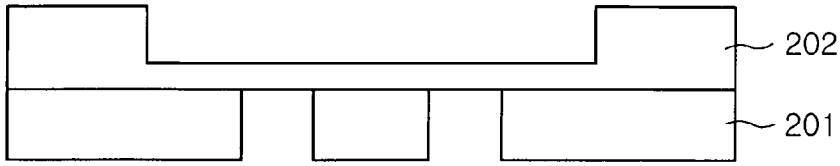

Afterwards, as shown in FIG. 3B, the vibration plate 202 has a top surface partially removed in a thickness direction thereof. As described above, the recess is formed in the vibration plate 202 to embed the lower electrode and the piezoelectric body therein. Here, the recess may be formed by any etching process known in the art, for example, inductively coupled plasma (ICP) or wet etching. As will be described later, the etching blocking layer shown in FIGS. 5A through 5E enables the recess to be formed more easily.

Figure 3C:
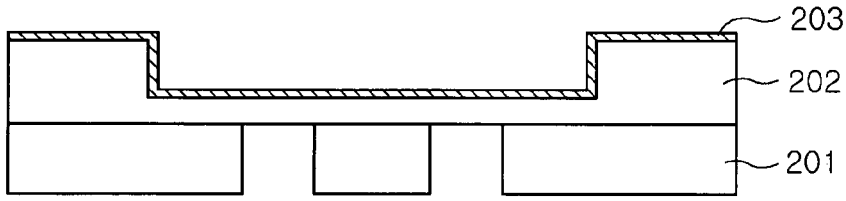

Next, as shown in FIG. 3C, the lower electrode 203 is formed to cover a bottom surface and a side wall of the recess of the vibration plate 202. The lower electrode 203 serves to apply a voltage to the piezoelectric body together with the upper electrode. The lower electrode 203 may be formed by plating or depositing a conductive material. Referring to FIG. 3C, the lower electrode 203 is formed to also cover the top surface of the vibration plate 202. Alternatively, the lower electrode 203 may be formed only within the recess of the vibration plate 202.

Figure 3D:
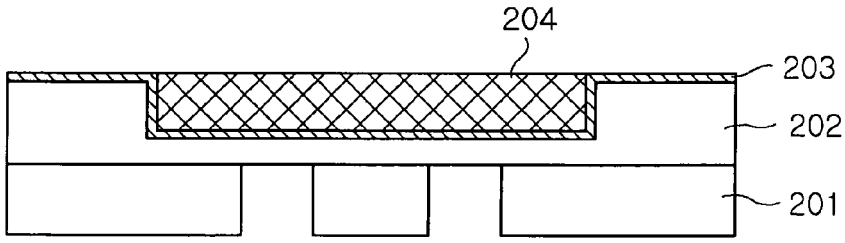
Figure 4:
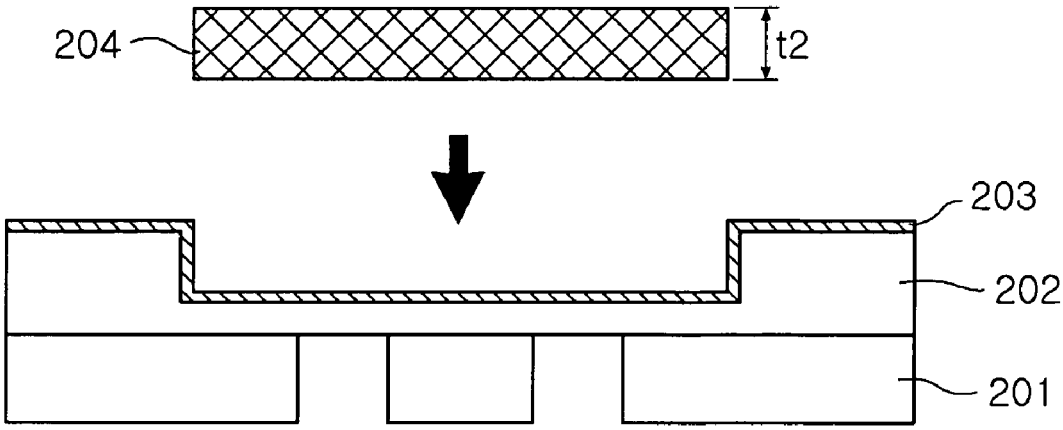
FIG. 4 is a detailed view illustrating a process shown in FIG. 3D.

Subsequently, as shown in FIG. 3D, the piezoelectric body 204 is formed on the lower electrode 203 to fill the recess of the vibration plate 202. The piezoelectric body 204 is formed of a ceramic material or a crystal piece capable of vibration when a voltage is applied. In the present embodiment, as shown in FIG. 4, the piezoelectric body 204 is previously prepared in a bulk shape and then bonded to the lower electrode 203. Here, the piezoelectric body 204 prior to being polished to a small thickness does not need to have a desired small thickness but may have a thickness t2 of 80 to 120 μm.

Unlike the present embodiment, the piezoelectric body may be formed by mixing a ceramic powder with a polymer binder, and screen printing and sintering the mixture. However, such a piezoelectric body, even though relatively easily adjusted in thickness, is weak in durability and degraded in capability over the piezoelectric body formed in a bulk shape. Yet, the bulk-shaped piezoelectric body is hardly machined to a thickness of 100 μm or less. Thus, it is an intricate job to produce an inkjet head activator by polishing the piezoelectric body of a bulk shape into a smaller thickness and then bonding the thin film piezoelectric body to the vibration plate. To overcome this problem, in the present embodiment, the piezoelectric body 204 with a relatively great thickness of 100 μm is embedded in the recess of the vibration plate 202 and then polished together with the vibration plate 202 in a later process.

Figure 3E:
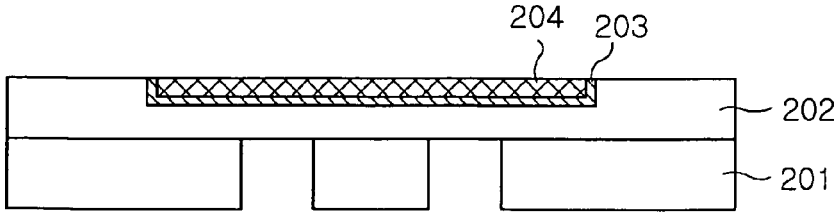

This will be described with reference to FIG. 3E. As shown in FIG. 3E, with the piezoelectric body 204 bonded, the top surface of the vibration plate 202 and a top surface of the piezoelectric body 204 are polished such that the piezoelectric body 204 has a thickness of 20 to 30 μm. At this time, the lower electrode 203 may be also polished. The polishing can be performed by chemical mechanical polishing (CMP). Here, the piezoelectric body 204 embedded in the vibration plate 202 is polished together with the vibration plate 202. This ensures a more precise and convenient process over a conventional process in which the piezoelectric body 204 is polished independently and then bonded. That is, the piezoelectric body 204 is polished while being bonded to the vibration plate 202 and the chamber plate 201, thereby allowing the polishing process to be easily controlled.

Thereafter, the upper electrode is formed on the piezoelectric body 204 by plating or deposition. A complete structure of the inkjet head activator is shown in FIG. 2.

FIGS. 5A through 5E are procedural cross-sectional views illustrating a method of manufacturing an inkjet head activator according to a modified embodiment of FIGS. 3A through 3E.

Figure 5A:
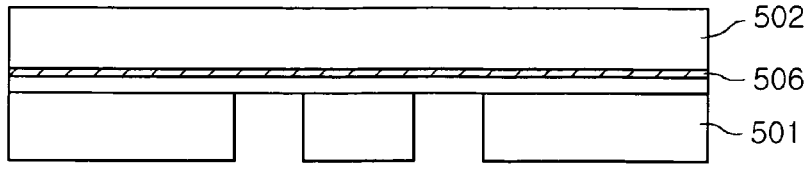
FIGS. 5A through 5E are procedural cross-sectional views illustrating a method of manufacturing an inkjet head driver according to a modified embodiment of FIGS. 3A through 3E.
Figure 5B:
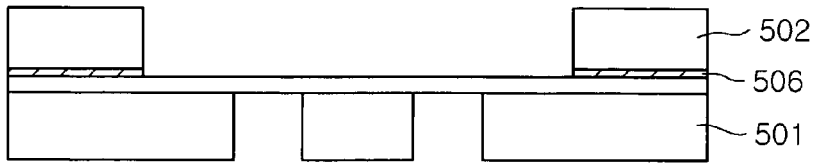
Figure 5C:
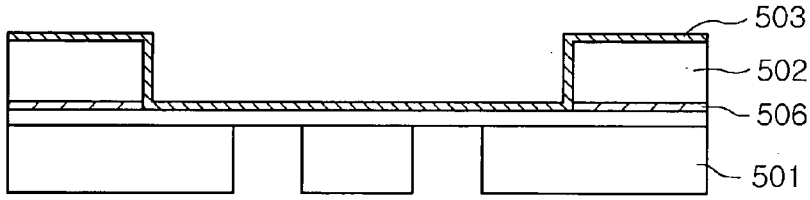
Figure 5D:
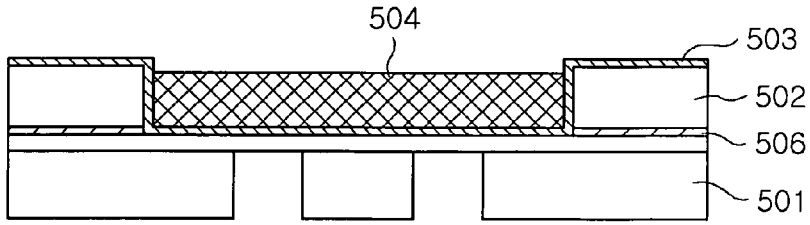
Figure 5E:
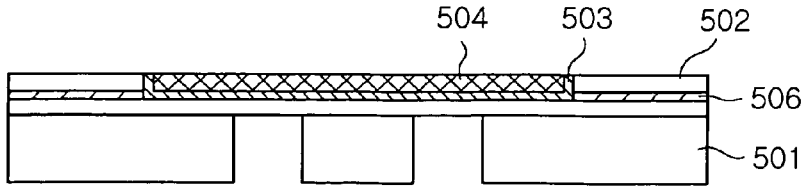

Referring to FIGS. 5A to 5E, as shown in FIGS. 3A through 3E, to manufacture the inkjet head activator, a chamber plate 501 and a vibration plate 502 are provided, a recess is formed in the vibration plate 502 by etching, a lower electrode 503 is formed, a piezoelectric body 504 is bonded, and the vibration plate 502 and the piezoelectric body 504 are polished. The present embodiment is different from the previous embodiment of FIGS. 3A through 3E in that an etching blocking layer 506 is formed inside the vibration plate 502 to facilitate a later process of forming the recess. The etching blocking layer 506 may be formed of an oxide such as $SiO_2$. As shown in FIG. 5C, the etching blocking layer 506, when disposed at a position corresponding to a desired thickness of the vibration plate 502, allows the recess to be adequately adjusted in depth.

As set forth above, according to exemplary embodiments of the invention, an inkjet head activator includes a thin film piezoelectric body and a vibration plate to ensure large vibration displacement and a low driving voltage. Also, such an inkjet head activator including the thin film piezoelectric body and vibration plate can be manufactured. This inkjet head activator reduced in thickness can simplify a driving waveform, and thus ensures less interference among vibration cells of the actuator to improve ejection frequency characteristics.

While the present invention has been shown and described in connection with the exemplary embodiments, it will be apparent to those skilled in the art that modifications and variations can be made without departing from the spirit and scope of the invention as defined by the appended claims.

What is claimed is:

1. An inkjet head actuator comprising:

a vibration plate having a recess formed in a top surface thereof;

a first electrode formed to cover a bottom surface and a side wall of the recess;

a piezoelectric body formed on the first electrode to fill the recess; and a second electrode formed on the piezoelectric body, wherein the top surface of the vibration plate is co-planar with a top surface of the piezoelectric body.

2. The inkjet head actuator of claim 1, wherein the piezoelectric body has a thickness of 20 to 30 μm.

3. The inkjet head actuator of claim 1, wherein the piezoelectric body is bonded to the first electrode.

4. The inkjet head actuator of claim 1, wherein the vibration plate is formed of silicon.

5. A method of manufacturing an inkjet head actuator, the method comprising:

forming a recess in one surface of a vibration plate;

forming a first electrode to cover a bottom surface and a side wall of the recess;

forming a piezoelectric body on the first electrode to fill the recess; and polishing the one surface of the vibration plate where the recess is formed and an exposure surface of the piezoelectric body such that the vibration plate and the piezoelectric body are reduced in thickness, wherein the polishing the one surface of the vibration plate where the recess is formed and an exposure surface of the piezoelectric body comprises polishing the vibration plate and the piezoelectric body to be co-planar with each other.

6. The method of claim 5, wherein the forming a piezoelectric body on the first electrode to fill the recess comprises bonding the piezoelectric body to the first electrode.

7. The method of claim 5, wherein the polishing the one surface of the vibration plate where the recess is formed and an exposure surface of the piezoelectric body comprises polishing the vibration plate and the piezoelectric body simultaneously.

8. The method of claim 5, wherein the polishing the one surface of the vibration plate where the recess is formed and an exposure surface of the piezoelectric body comprises polishing the piezoelectric body to a thickness of 20 to 30 μm.

9. The method of claim 5, wherein the polishing the one surface of the vibration plate where the recess is formed and an exposure surface of the piezoelectric body comprises performing chemical mechanical polishing.

10. The method of claim 5, wherein the forming a piezoelectric body on the first electrode comprises polishing the piezoelectric body to a thickness of 80 to 120 μm.

11. The method of claim 5, wherein the vibration plate comprises an etching blocking layer formed therein.

12. The method of claim 11, wherein the forming a recess in one surface of a vibration plate comprises etching the vibration plate up to the etching blocking layer.

* * * * *

UNITED STATES PATENT AND TRADEMARK OFFICE

CERTIFICATE OF CORRECTION

PATENT NO. : 8,100,514 B2
APPLICATION NO. : 12/314620
DATED : January 24, 2012
INVENTOR(S) : Sang Jin Kim et al.

It is certified that error appears in the above-identified patent and that said Letters Patent is hereby corrected as shown below:

On the Cover Page of the Issued Patent, Under (56) References Cited and after FOREIGN PATENT DOCUMENTS, insert

-- U.S. PATENT DOCUMENTS

| | | | |
|---|---|---|---|
| 2007/0195132 | A1 | 08/23/2007 | Lee et al. |
| 2007/0186397 | A1 | 08/16/2007 | Lim et al. --, therefor. |

Signed and Sealed this
Twenty-fourth Day of April, 2012

David J. Kappos

David J. Kappos
*Director of the United States Patent and Trademark Office*